US007156776B2

(12) United States Patent
Maser

(10) Patent No.: US 7,156,776 B2
(45) Date of Patent: Jan. 2, 2007

(54) EASY ACCESS STEPPER

(76) Inventor: Donald Clifton Maser, 325 Bell Ave., Altoona, PA (US) 16602

( * ) Notice: Subject to any disclaimer, the term of this patent is extended or adjusted under 35 U.S.C. 154(b) by 450 days.

(21) Appl. No.: 10/425,300

(22) Filed: Apr. 29, 2003

(65) Prior Publication Data

US 2004/0220019 A1 Nov. 4, 2004

(51) Int. Cl.
*A63B 22/04* (2006.01)

(52) U.S. Cl. ..... 482/52; 482/51

(58) Field of Classification Search ..... 482/51–53, 482/57–65, 70–71, 111–113, 148
See application file for complete search history.

(56) References Cited

U.S. PATENT DOCUMENTS 3,970,302 A 7/1976 McFee ..... 272/130
4,591,032 A 5/1986 Itazu ..... 188/313
4,733,858 A * 3/1988 Lan ..... 482/53
4,838,543 A 6/1989 Armstrong ..... 272/70
5,230,676 A * 7/1993 Terauds ..... 482/53
5,792,029 A * 8/1998 Gordon ..... 482/52
5,890,996 A * 4/1999 Frame et al. ..... 482/8

* cited by examiner

*Primary Examiner*—Stephen R. Crow

(57) ABSTRACT

An apparatus is disclosed for an easy to mount and easy to use exercise machine especially helpful to disabled, convalescing and elderly people. Both foot pedals (148) are at their lowest position to start and are dependent on each other. The lever-arms (146) have a long turning radius that minimizes the angle-change of the pedals. The apparatus (30) has a protective cover (32), two foot pedals (148), two lever arms (146), an energy dissipation means (106) with a neutral positioning means for the pedals, a variable exertion-force adjustment means (105), a pedal dependency mechanism (74,94), a transmission (68), an exertion monitoring device (44), handle bars (166), a frame (142), and is easily modified to include an elevator mechanism (120) that raises and lowers the pedals. The unique design keeps most of the moving parts in constant tension eliminating both noise and wear due to direction changes and the need for tight tolerances. The unique design also keeps most of the forces in a straight line eliminating wear and the need for heavy high strength parts.

1 Claim, 11 Drawing Sheets

68

62

62

EASY ACCESS STEPPER

CROSS REFERENCE TO RELATED APPLICATIONS

None

BACKGROUND

1. Technical Field

The present invention relates to an exercise machine and more specifically to a hydraulic stepper exercise machine of the dependent pedal type.

2. Description of the Related Art

Presently there are two groups of stepper exercise machines: a group with "dependent" pedal action (dependent steppers) and a group with "independent" pedal action (independent steppers).

In order to understand these steppers consider that if one pedal of a dependent stepper is stopped completely the other pedal is stopped at an alternate position. For example, if one pedal is stopped at its lowest position the other pedal is stopped at its highest position. In addition the pedals move at the same velocity and in opposite vertical directions. These features make a dependent stepper easy to use. A simple mechanism, instead of the user, keeps the pedals in correct alternate position and the resting foot is raised to the top of each successive stroke by this mechanism.

In an independent stepper, if one pedal is stopped completely the other pedal is free to be at any position and move at any velocity in either vertical direction. These features make an independent stepper more difficult to use. The user is required to keep the pedals in proper alternate position with his or her feet and is required to raise the resting foot for each successive stroke. These requirements interfere with user's concentration, impart an unstable feeling to the user and make an independent stepper a poor choice for a senior citizen.

Each of these two steppers is difficult to mount, but the dependent stepper is the easier of the two because its lowest pedal can be chosen as the start pedal. Conversely, the independent stepper is more difficult to mount because its pedals are both at their highest position to start.

The present invention is a dependent stepper and has all the advantages of being a dependent stepper and is easier to use because it has a longer turning-radius for each of its lever-arms. This minimizes the angle-change of the pedals during use. More importantly it is easier to mount because both of its pedals are at their lowest position to start.

A commercially successful dependent, hydraulic stepper is shown in U.S. Pat. No. 4,838,543 (1989) to Armstrong and is the closest stepper found to the present invention. This stepper uses a linear hydraulic damper as an energy dissipating mechanism and lever-arms called foot-beams as pedals. This stepper is an example of the step-up mounting problem, not solved by present dependent steppers. Once the lowest pedal is fully depressed to start the other pedal is at its highest position or the maximum stroke of the stepper and must be mounted with the other foot.

Other negative aspects of the Armstrong stepper are as follows: It requires a separate take-off to a pedal dependency-mechanism shown by a rope and sheave (idler-wheel). Its lever-arms have a short turning-radius that increases the angle-change of the pedals causing the user's ankles to over rotate. These problems are eliminated by the present invention.

The U.S. Pat. No. 3,970,302 (1976) to McFee is the most basic and comprehensive in regards to the prior art of stepper exercise machines, but none of the embodiment drawings show both stepper pedals simultaneously in the lowest position for easy mounting.

In FIGS. 4 and 5 of the McFee patent a non-lever-arm embodiment is shown with a pedal dependency-mechanism that is inherently part of its transmission and like the present invention does not require a separate take-off.

This stepper is a non-lever-arm stepper and was never commercially produced or successfully reduced to practice because a rotary, reversing, hydraulic pump that can accept a reciprocating input of clockwise and counter-clockwise motion, of about one revolution, and also accept a low torque load does not exist. There is one type of pump for each condition but not a pump for both conditions.

Even if the pump did exist, this pump used in conjunction with a resistance flow valve as shown, could not form a rotary hydraulic damper for this machine. A true commercial model would also need a sealed and gas padded reservoir to serve the following three functions: make up for minute losses of working fluid, release air from entrapment, and to allow for the expansion and contraction caused by temperature changes in the working fluid due to the environmental changes and fluid friction.

This McFee stepper also requires the user to take long flat steps using leg muscles in a way that is closer to a cross-country skiing machine than a more conventional up and down stepper. This mode of stepping gives very little leverage to the leg muscles and is a poor loading match to a hydraulic pump. Even a very small pump can handle hundreds of pounds of torque. The low slip type of pump that could handle the condition of reciprocating-rotary-input has a starting resistance that is much greater than the maximum force produced by the leg muscles in conjunction with this stepper.

The transmission of the present invention adapts linear dampers that are successful in the Armstrong type steppers to rotary use. In effect this produces a lever-arm stepper in combination with a rotary-damper. This combination in the present invention retains an advantage of the McFee stepper in that both the rotary-damper and the dependency-mechanism use the same take-off points but again the McFee stepper is a non-lever-arm machine and its rotary-damper (actuator) was never feasibly implemented.

In apartment complexes that cater to senior citizens, the exercise rooms rely mostly on safe, low setting, easily accessible stationary bicycles. These bikes are also light in weight, inexpensive and are popular for in-home use.

The human body evolved to do the outdoor activities of walking, running and grade climbing well and therefore is best adapted for indoor exercises that imitate these activities.

Although stationary bicycles are popular, the sitting exercise position is not comfortable for all people, and the mounting of a stationary bicycle requires some straddling and twisting maneuverability among or on awkwardly placed pedals. This is not easy for all senior citizens.

Some apartment complexes will risk a motorized treadmill but the senior citizens mostly avoid treadmills for fear of the uncontrolled power that could easily trip them, cause a fall and cause an injury.

Motorized tread-milling imitates the activities of walking and running, but is dangerous for an indoor activity in either mode. Even with the proper mounting technique mastered and careful use of the speed-dial one must never forget to attach the automatic-shut-off clip to one's garment and it must be attached securely enough that during a fall it will shut-down the machine.

In walking, like actual walking, tread-milling gives an easy workout but is time consuming and difficult to get a good aerobic workout. And in running, like actual running, tread-milling gives a faster more vigorous workout, but running gives high impact stresses to the joints and is too vigorous for most senior citizens.

The stepper imitates the activity of grade climbing and has the same advantages: It gives an aerobic and low impact workout in a short period of time. The stepper is also safe, light in weight, inexpensive, and with the improvements created by the present invention, the dependent stepper will be the easiest of all exercise machines to mount and use. These advantages are important not only for the reasons already stated but also for the following: Many physicians believe that moderate exercise is the number one factor for over all good health and longevity. Experts in physical training believe that ease and convenience is the number one factor to determine whether an individual will stick with an exercise program.

In conclusion it should be noted that a special linear damper was patented for use with the Armstrong type machine, see U.S. Pat. No. 4,591,032 (1986) to Itazu. This damper has a settable and adjustable resistance dial for changing its resistance internally. This adjustment is easier than changing the resistance by adjusting the connection point of the damper to the lever-arm as in the Armstrong patent.

Itazu type dampers (internal spring type) are incorporated in the present invention as a means of dissipating energy and returning the transmission to a neutral position.

SUMMARY

In accordance to the present invention this apparatus is a dependent type stepper that includes a means for returning both pedals to their neutral position; is modifiable to accept a means for raising and lowering both pedals for easy user access; requires only one take-off on each lever-arm that connects to both an energy dissipation means and a pedal dependency means; further includes two pedals, two lever arms, a transmission, a frame and a means for energy dissipation.

OBJECTS AND ADVANTAGES

Accordingly, besides the objects and advantages of Armstrong type dependent stepper described in the above text, several objects and advantages of the present invention are:

(a) to provide a stepper that has both pedals on the floor for easy mounting;

(b) to provide a stepper that has lever-arms with a long turning radius that minimizes the angle-change of the pedals;

(c) to provide an easily covered, safe stepper;

(d) to provide a lightweight stepper;

(e) to provide an inexpensive stepper.

Further objects and advantages will be summarized throughout the following text.

DRAWING FIGURES

The sections are best sections. Only that which will clarify the configuration is given section lines.

DESCRIPTION

For simplification and clarity some standard parts are not numbered or are not shown or both, but are understood. Bolts and nuts have clearance holes, lock washers and flat washers. Bolts have a tapped hole instead of a nut. All screws are sheet metal screws and have pilot and clearance holes. Pivotal areas and sliding areas have appropriate bearings and lubrication. Common fasteners such as cements, straps, and harnesses are not shown. Some welds are shown for clarity.

The apparatus is almost symmetrical about its longitudinal axis so the same part numbers are used with the addition of 'L' and 'R' for the left and right sides of the mounted user. All other repeated occurrences of duplicates will start with the letter 'A' and proceed away from the user, from his or hers up to down or from his or hers right to left. A repeated occurrence is only given once and without letters unless letters and additional call-outs make the drawings and description easier to understand.

Most structural parts (the structural means for holding elements in a working positional relationship) for the frame and transmission are painted, hollow-steel-tubes.

Holes for running control wires through the frame at suitable locations are not shown.

A way of connecting parts together is by an interference fit. In the following embodiment the interference connection is indicated by the word pressed.

Figure 1:
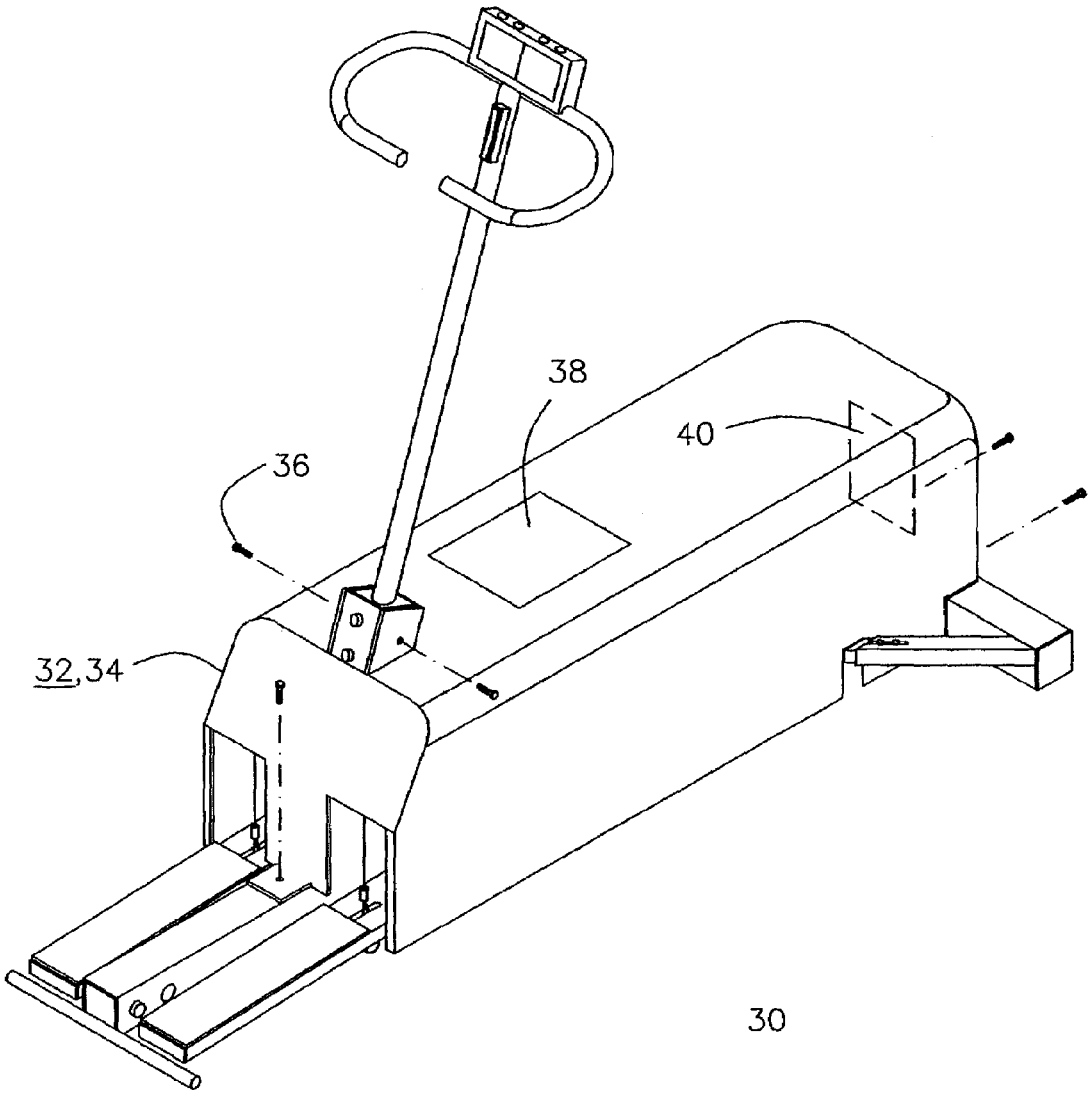
FIG. 1 shows a complete stepper with protective cover as if it were ready for use.

An embodiment of the present invention is illustrated in FIG. 1 with a protective cover (enclosure) 34. The cover is held in place by attachment screws 36. The cover has an access door on top for damper adjustment 38 and also a door 40 on its far end for access to a rechargeable battery 58.

Figure 2:
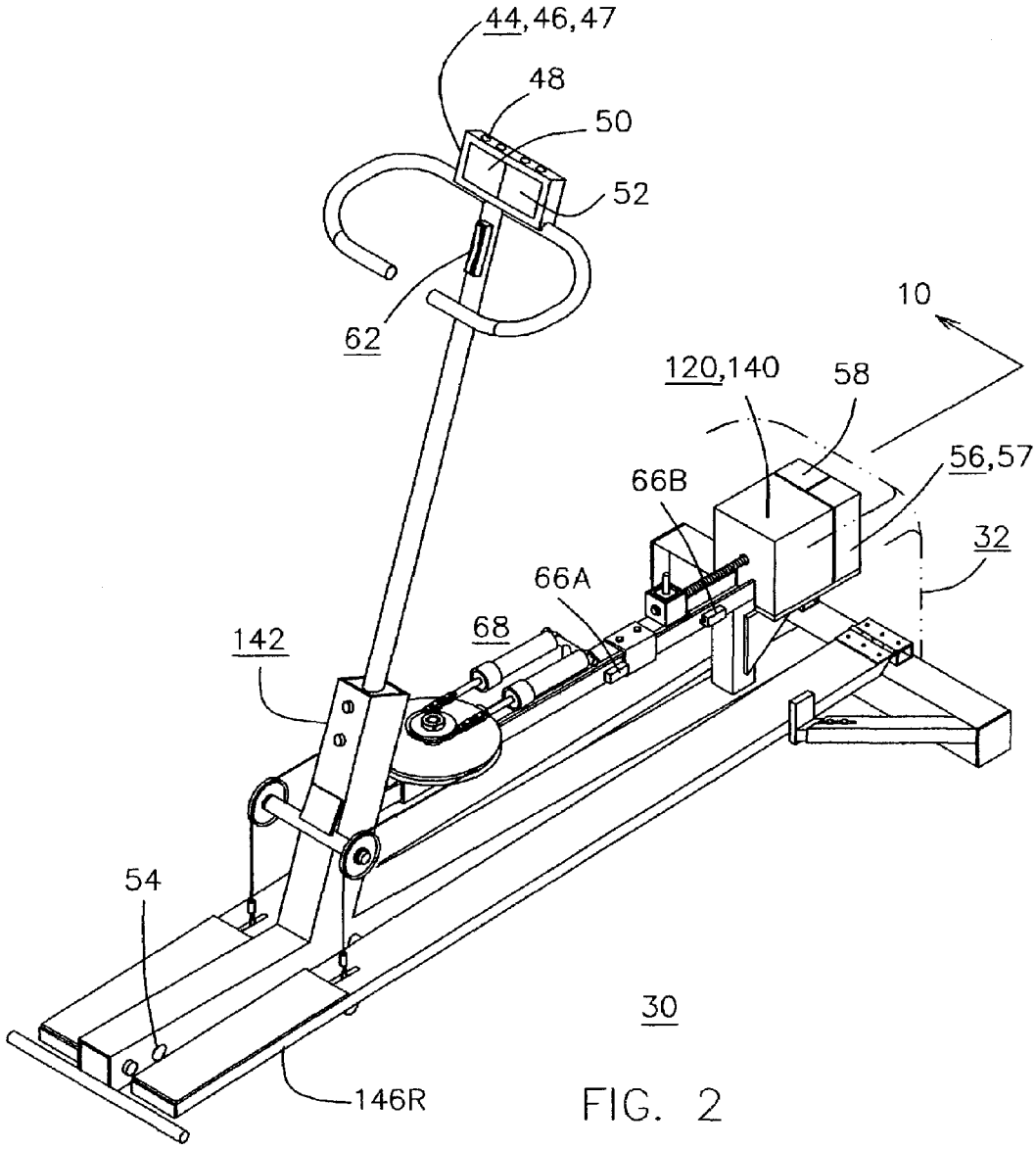
FIG. 2 shows the complete stepper with all sub-assemblies and miscellaneous electrical and display parts called out.
Figure 10:
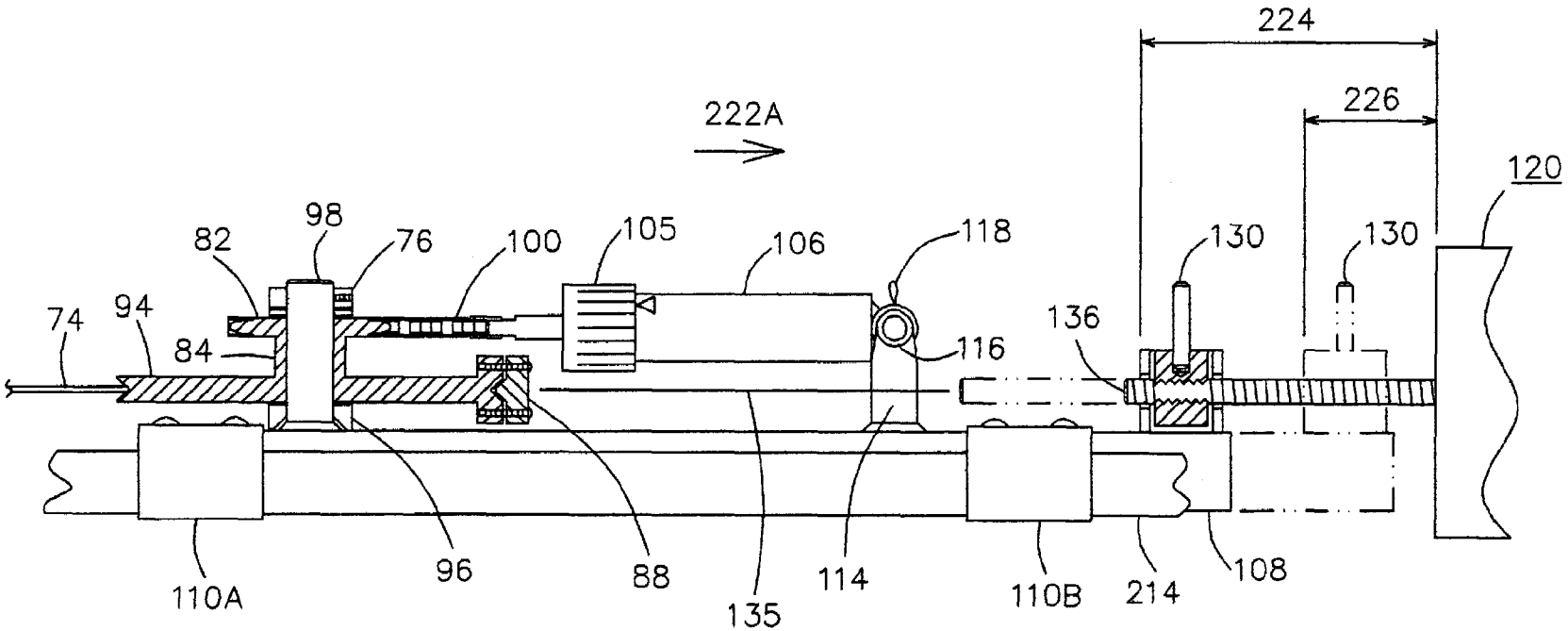
FIG. 10 is a section on line 10 of FIG. 2.

In FIG. 2 a complete stepper 30 is shown with the following sub-assemblies: a display 44, a rocker-switch 62, a frame 142, a transmission 68, an elevator 120, a control 56, an enclosure 32 and the section line 10 of FIG. 10.

FIG. 2 further shows the location of parts in the display 44 including: a display enclosure 46, an internal replaceable storage battery 47, display control buttons 48, a count-down timer with alarm screen 50, a step-counter screen 52, and a proximity sensor 54.

The sensor 54 responds to the nearness of a lever-arm 146R. The self-contained display 44 and its components are common on many exercise machines and have a set of wires from the proximity sensor 54 to the display enclosure 46.

FIG. 2 further shows the location of the control 56 including: a control enclosure 57, the rocker-switch 62, a normally-closed switch 66A, a normally-closed switch 66B, and the rechargeable battery 58. These parts are also shown on the electrical schematic FIG. 11. The rocker-switch is shown again on the rocker-switch position diagrams FIGS. 12 and 13.

Figure 11:
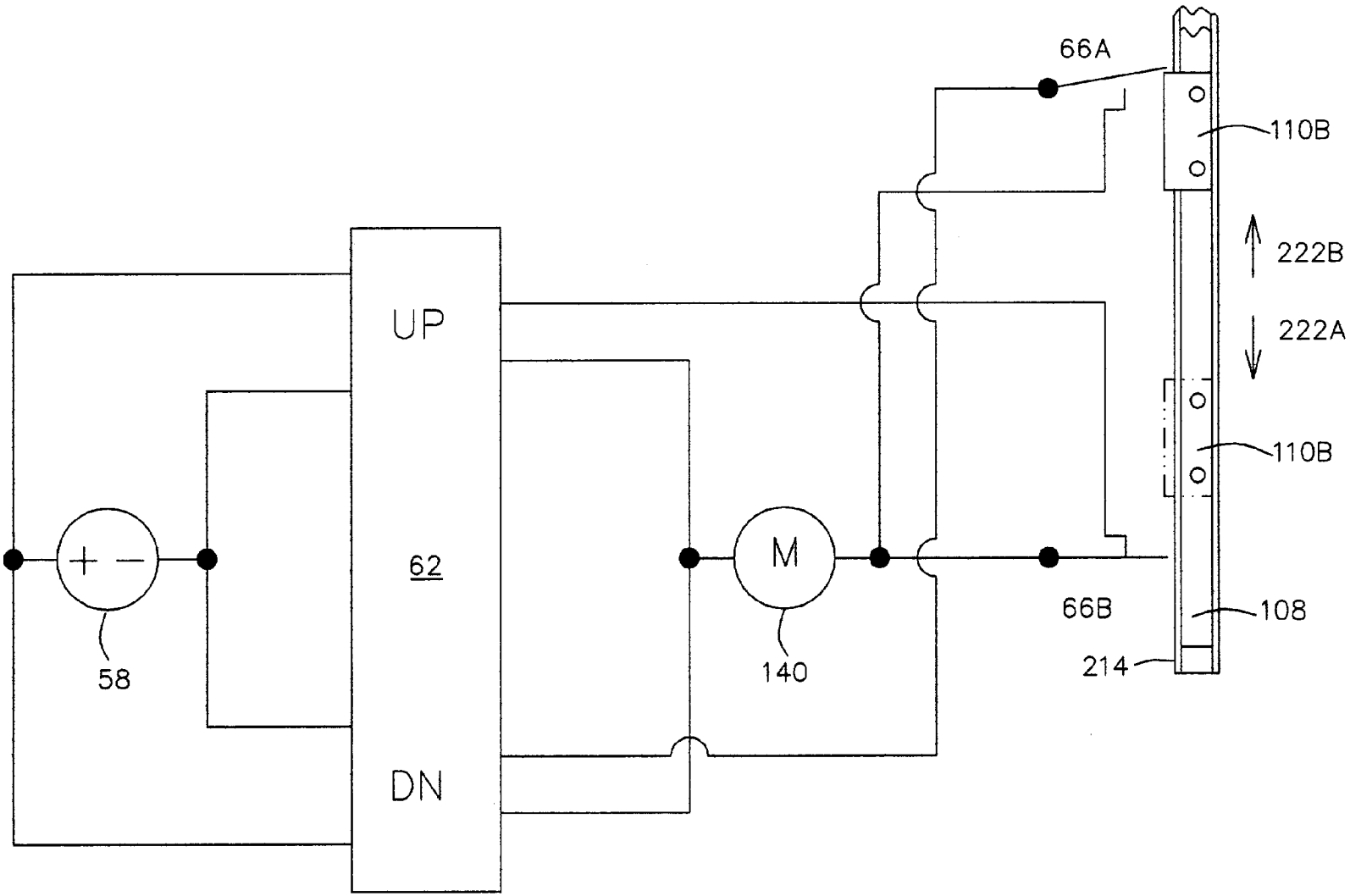
FIG. 11 is an electrical schematic for the controls.
Figure 12:
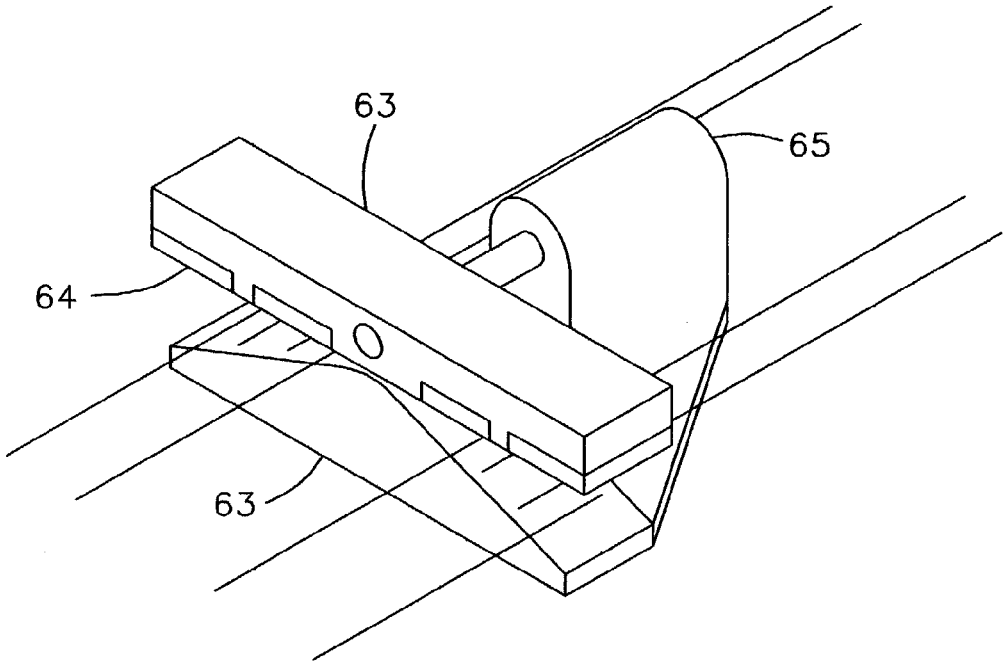
FIG. 12 is the rocker-switch diagramed in the passive position.

FIG. 11 is a common electrical circuit with common electrical components that is shown for simplicity in more understandable terms than is used in standard electrical design practice.

For simplicity the electrical controls are shown as if the elevator's power was supplied by the rechargeable battery 58 and a separate charger not shown. It is understood that if standard well-known design modifications are made to the electrical schematic FIG. 11 the elevator motor can be run from a power cord with alternating current from a wall plug.

Figure 3:
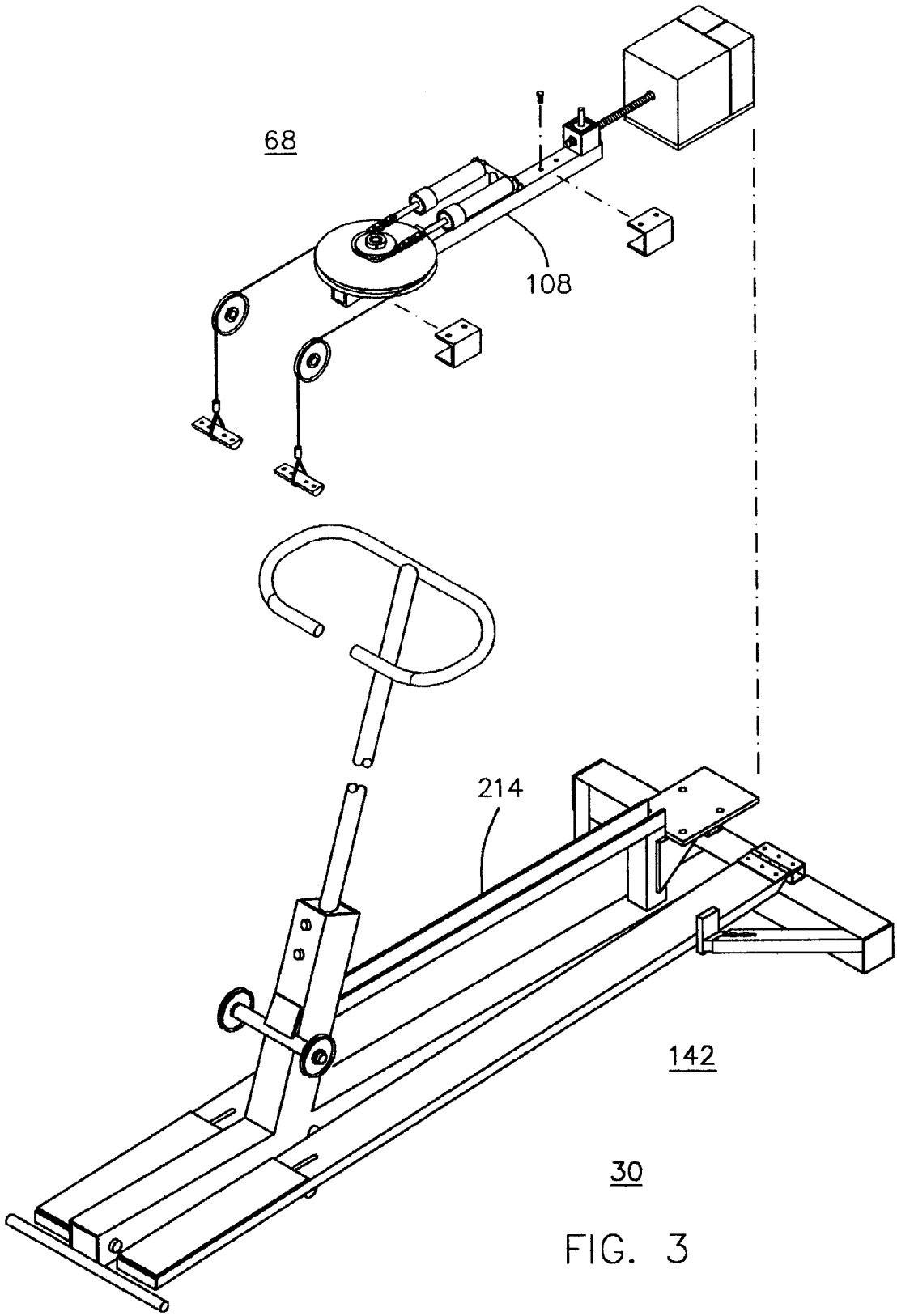
FIG. 3 shows the stepper taken apart into its two main sub-assemblies.
Figure 4:
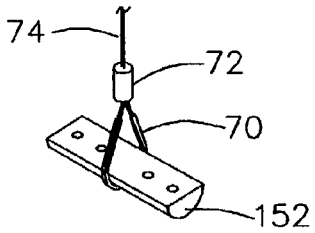
FIG. 4 shows four parts of the transmission enlarged.
Figure 5:
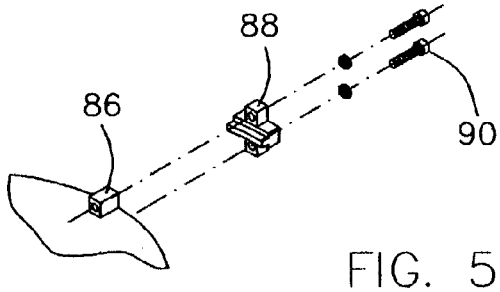
FIG. 5 shows six parts of the transmission enlarged.

In the exploded stepper 30 FIG. 3, the transmission 68 and the frame 142 are separated so that the sliding of transmission carriage 108 inside frame rail 214 can be visualized.

Figure 6:
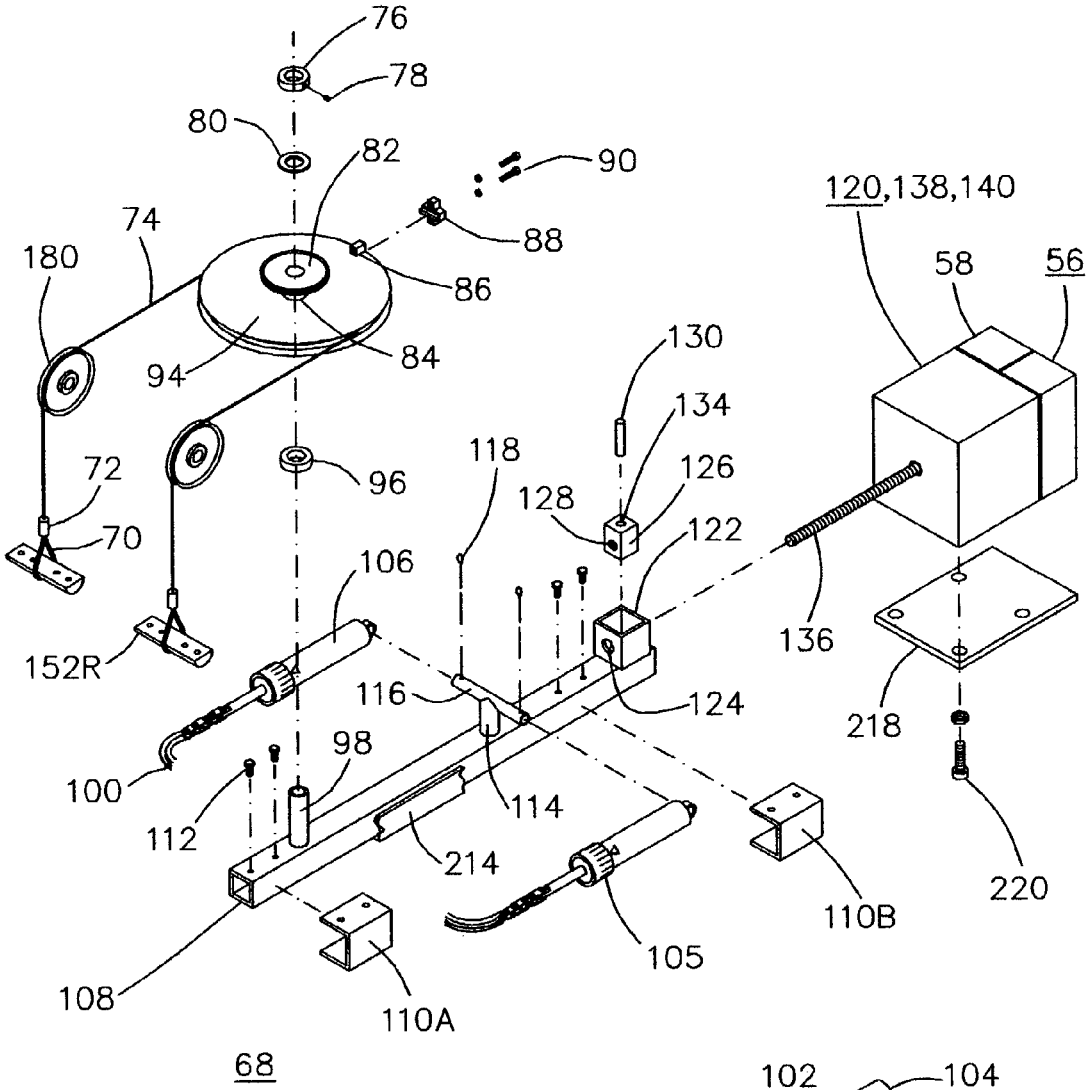
FIG. 6 shows the transmission as if it were taken apart in logical order.
Figure 7:
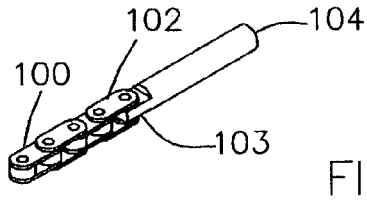
FIG. 7 shows four parts of the transmission enlarged.
Figures 8, 9:
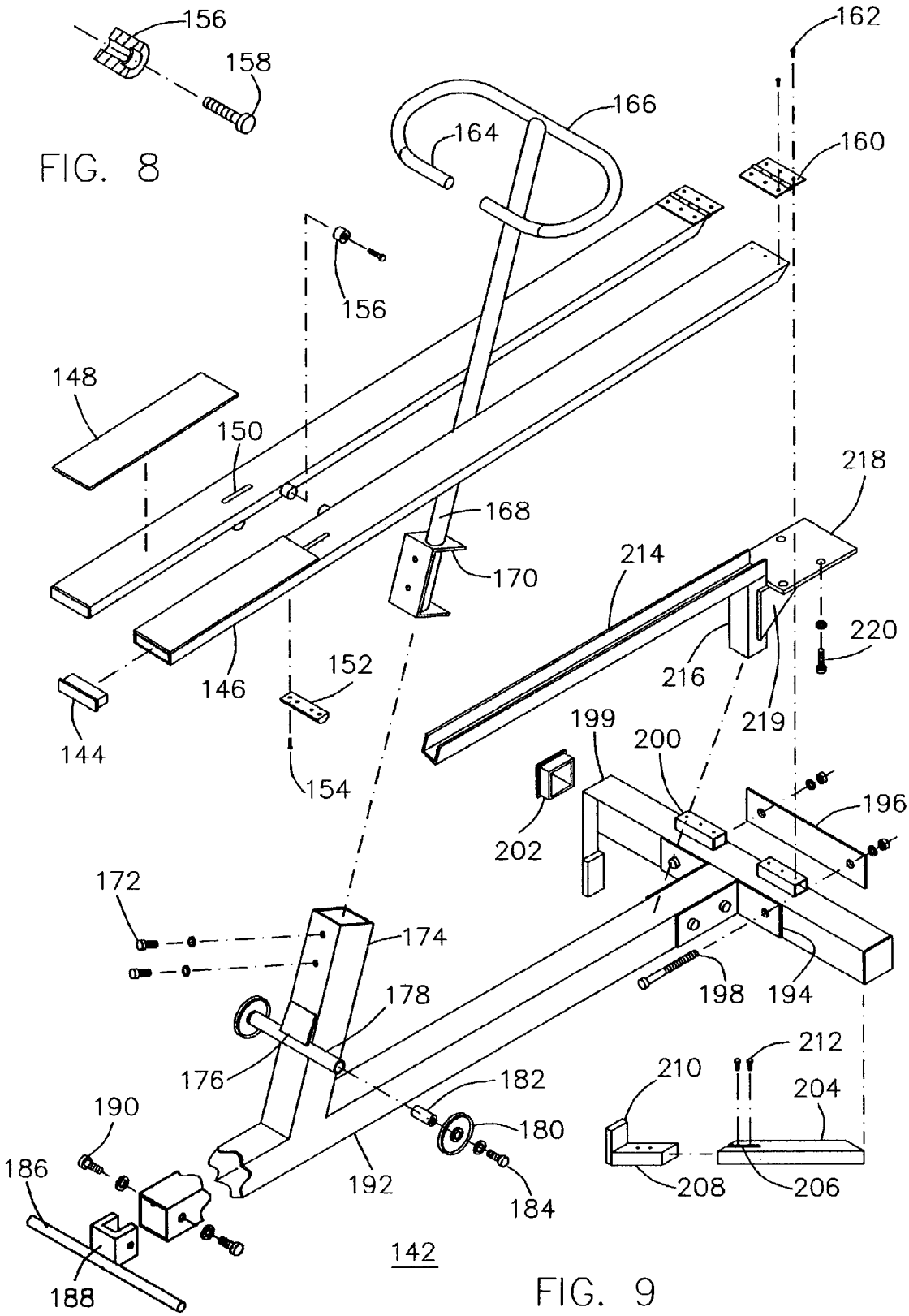
FIG. 8 shows 2 parts of the frame enlarged.
FIG. 9 shows the frame as if it were taken apart in logical order.

In the exploded transmission 68 view FIG. 6, crossbars 152, sheaves (idler-wheels) 180 and rail 214 are frame parts and are cross-referenced from frame 142 FIG. 9. Cable crossbars 152 engage a continuous-flexible-member (cable) 74 by a loop in the cable ends. The loop is made by taking the ends of the cable around thimbles 70 and crimping the cable ends to the cable with crimps 72. Cable 74 is locked to a pulley (drive-wheel) 94 with a clamp 88 and bolts 90. The pulley 94 is fixed to the bottom of a hollow shaft 84 and the shaft is fixed to the bottom of a sprocket (driven-wheel) 82. The previous three parts rotate about a pinion-post 98 and are held in place with a shaft-collar 76 and a setscrew 78 between a thrust washer 80 and a spacer 96. The pinion post 98 is welded to the top of a carriage 108. The carriage is held into a frame rail 214 by keepers 110A and 110B that allow the carriage to slide back and forth. The keepers are attached to the top of the carriage 108 with screws 112. An elevator coupling 122 is welded to the top of carriage 108 and loosely contains a special nut 126. The looseness is to compensate for any misalignment between the carriage 108 and its mechanical link (elevator-screw-shaft) 136 to the elevator. The special nut engages the screw-shaft and has a finger-grip 130 pressed into its top for aligning the nut with the screw-shaft during assembly. The screw-shaft 136 is driven by a speed reducer 138 and an electric motor 140. The motor (with optional overload protection) is given power from the rechargeable battery (power supply) 58 through the control 56. This elevator 120 is held to an elevator-mounting-plate 218 with bolts 220.

A sprocket 82 FIG. 6 engages a chain 100 and the ends of the chain are fastened to damper-shafts 104 with master-links 102 that go through a hole in shaft-flats 103. damper-shafts 104 are returned into the dampers 106 with an internal spring. The dampers are held in position on an arm 116 by carter-keys 118 and the arm is welded to a support post 114 and the support post is welded to the carriage 108. During assembly the crossbars 152 and therefore the pedals can be aligned in elevation to a neutral position of the damper springs by adjusting the cable 74 under the clamp 88.

In the exploded frame 142 FIG. 9, plastic pedal-end-caps 144 are pressed into the near ends of lever-arms 146 and fiber pedal-pads 148 are cemented to the lever-arms. The cable-cross-bars 152 are attached to the bottom of the lever-arms 146 with screws 154 and are longitudinally centered under cable-slots 150. Low-friction plastic guide-buttons 156 are attached to the inside of lever-arms 146 with screws 158. These buttons along with low-friction plastic strut-heads 210 keep the lever-arms straight so there are no cantilevered forces applied to pivots 160. The transmission cable 74 FIG. 6 runs through slots 150 FIG. 9 to the transmission over sheaves 180 that are attached to sheave-bushings 182 with bolts 184. The bushings are pressed into a sheave-axle 178. The axle is attached to a frame-upright 174 with welds and a weld-cleat 176.

Handgrips 164 are pressed over the ends of a handlebar 166. The handlebar is welded to a bar-post 168 and the post is welded into an adaptor 170. The adaptor is inserted into the top of the frame-upright 174 and attached to the upright with bolts 172.

A rear-stabilizer bar 186 is welded to bottom of a rear-adaptor 188 and the adaptor is attached to a frame-base 192 with bolts 190. The frame-base is welded to the frame upright and through-bolted and nutted 198 to a front-stabilizer 199 with the help of frame-angles 194 and a frame-plate 196. The front-stabilizer is closed by pressing plastic end-caps 202 into place.

The front-stabilizer 199 is welded to the bottom of pivot-seats 200 and the seats are attached to pivots 160 with screws 162. The far ends of lever-arms 146 are attached to pivots 160 with screws 162.

A guide-strut 204 is welded at an angle to the near face of the front-stabilizer 199 close to each of its ends. The guide-strut has a slot 206 on its top with an open end communicating with an open end of the strut. A strut-insert 208 is inserted into the end of the strut 204 and held there by screws 212 that engage the slot 206 and allow adjustment of the strut-insert 208. The strut-insert and the strut-head 210 are monolithic and are molded from low-friction plastic.

The frame-rail 214 is a channel with its legs pointing upward forming a track for the transmission-carriage 108 FIG. 6. The frame-rail 214 FIG. 9 is welded to the far side of the frame-upright 174 and the top of a rail-post 216. The rail-post is welded to the top of the frame-base 192.

A left and right gusset 219L and 219R are welded to the left and right sides of the rail-post 216 and to the bottom of the elevator mounting plate 218. The elevator 120 FIG. 6 is attached to the plate 218 FIG. 9 with bolts 220.

In FIG. 10, a section on line 10 of FIG. 2., line 135 shows that the center of the cable 74 lines up with the center of the elevator screw shaft 136. This unique feature of the transmission reduces to zero all the top and bottom forces between the transmission-carriage 108 and the frame-rail 214. In FIG. 6 it is easily seen that the static side forces between these two parts are zero. Here the vertical center of carriage 108 is also the vertical center between the cable 74 ends. The dynamic side forces produced by applying force to one pedal are easily handled by the long lever arm formed by the carriage 108.

In FIG. 10 the extreme positions of the carriage 108 are shown in relationship to the fixed elevator 120. If a distance 224 was 6 inches and a distance 226 was 2 inches, the difference between these two distances equals a movement in the carriage of 4-inches. This carriage movement produces a 4-inch rise in the lever-arms at the cable attachment points and produces an 8-inch maximum stoke in the lever-arms at the same point. See FIGS. 14,15,16. The maximum stroke is infinitely variable between the distances of zero-inches and 8-inches and is dependent on where the carriage is stopped.

In FIG. 10 the profiles of the pulley 94 and the sprocket 82 clearly show the 3 to 1 size ratio between these two parts that produce a 3 to 1 mechanical advantage and a 3 to 1 force increase going into the dampers 106. This higher force is needed to operate the dampers correctly and is equal to the mechanical advantage of the successful Armstrong type stepper.

The following objects and advantages are emphasized and made apparent by the previous text section and a familiarity with the drawing figures cited therein:

(a) the stepper can be broken down and shipped in a small box by common carrier;

(b) looseness, noise and wear are minimized because most of the moving parts are kept in constant tension by the user's weight and many of the parts are connected by tight clamps;

(c) most of the forces are kept in a straight line by the unique design of the transmission eliminating wear and eliminating moment-arms and the need for heavy, high-strength parts;

(d) it is easy to add a protective cover to the stepper;

(e) the transmission and frame are easily modified to accept an elevator means for raising and lowering the pedals;

(f) the transmission has about a 3 to 1 mechanical advantage that is helpful in operating hydraulic dampers.

(g) the stepper is easily modified to have a handlebar that is adjustable in height by simply putting a set screw in between the existing post-adaptor screws and eliminating the fixed connection between the post-adaptor and the bar-post.

Operation

Figure 13:
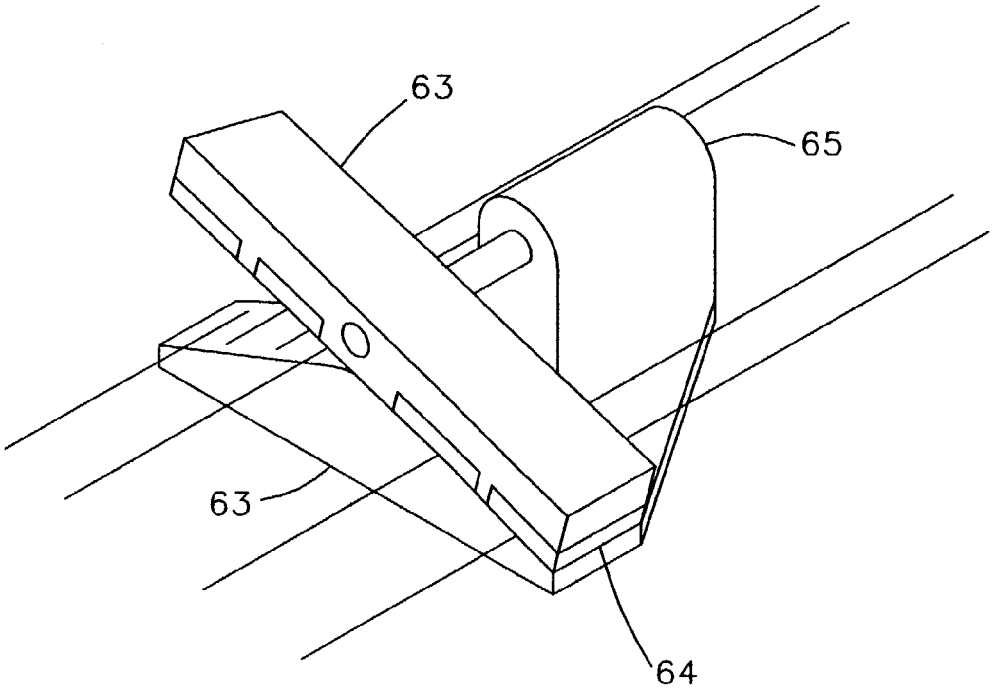
FIG. 13 is the rocker-switch diagramed in an active position.
Figure 14:
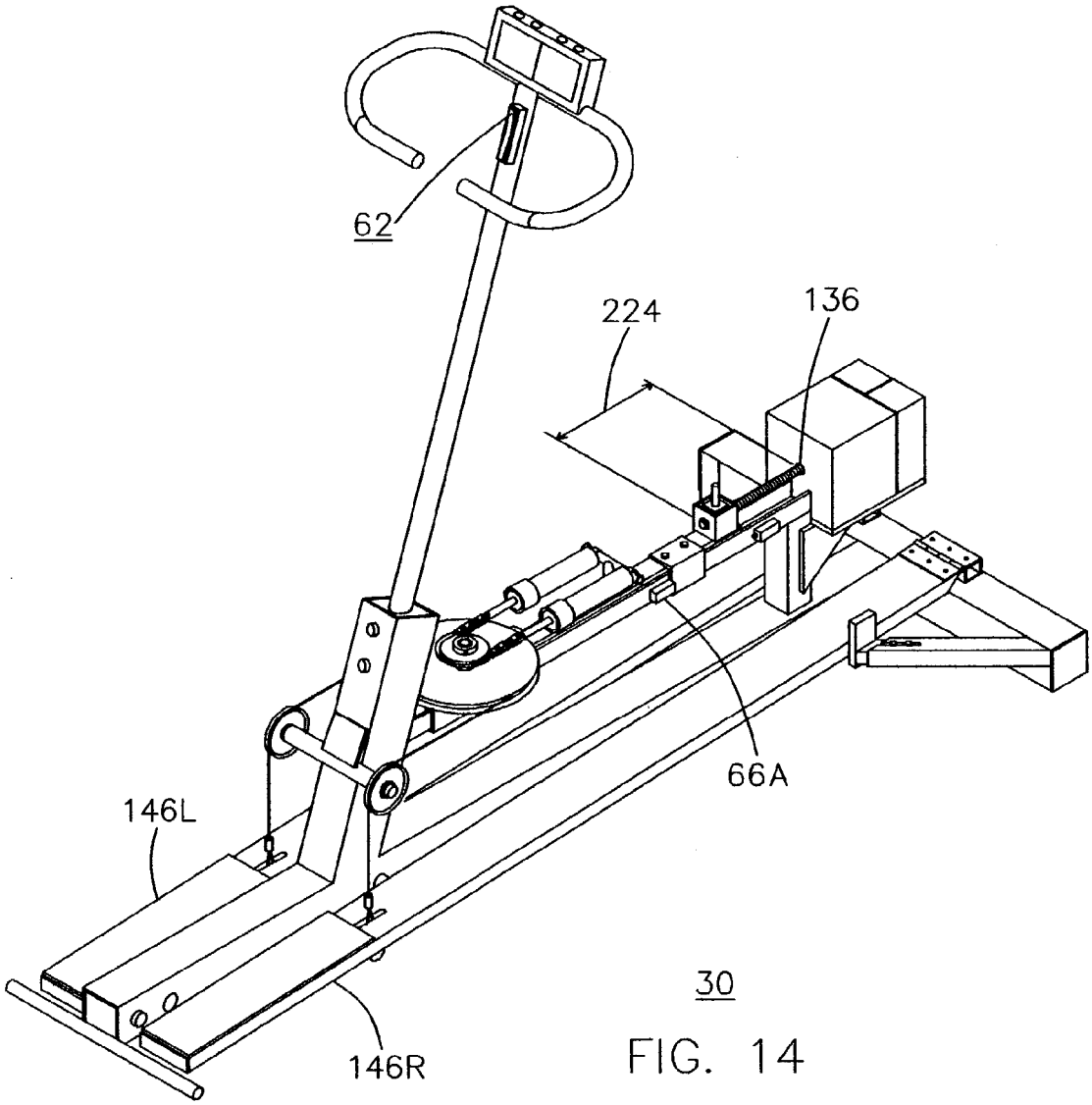
FIG. 14 shows the stepper in start position.
Figure 15:
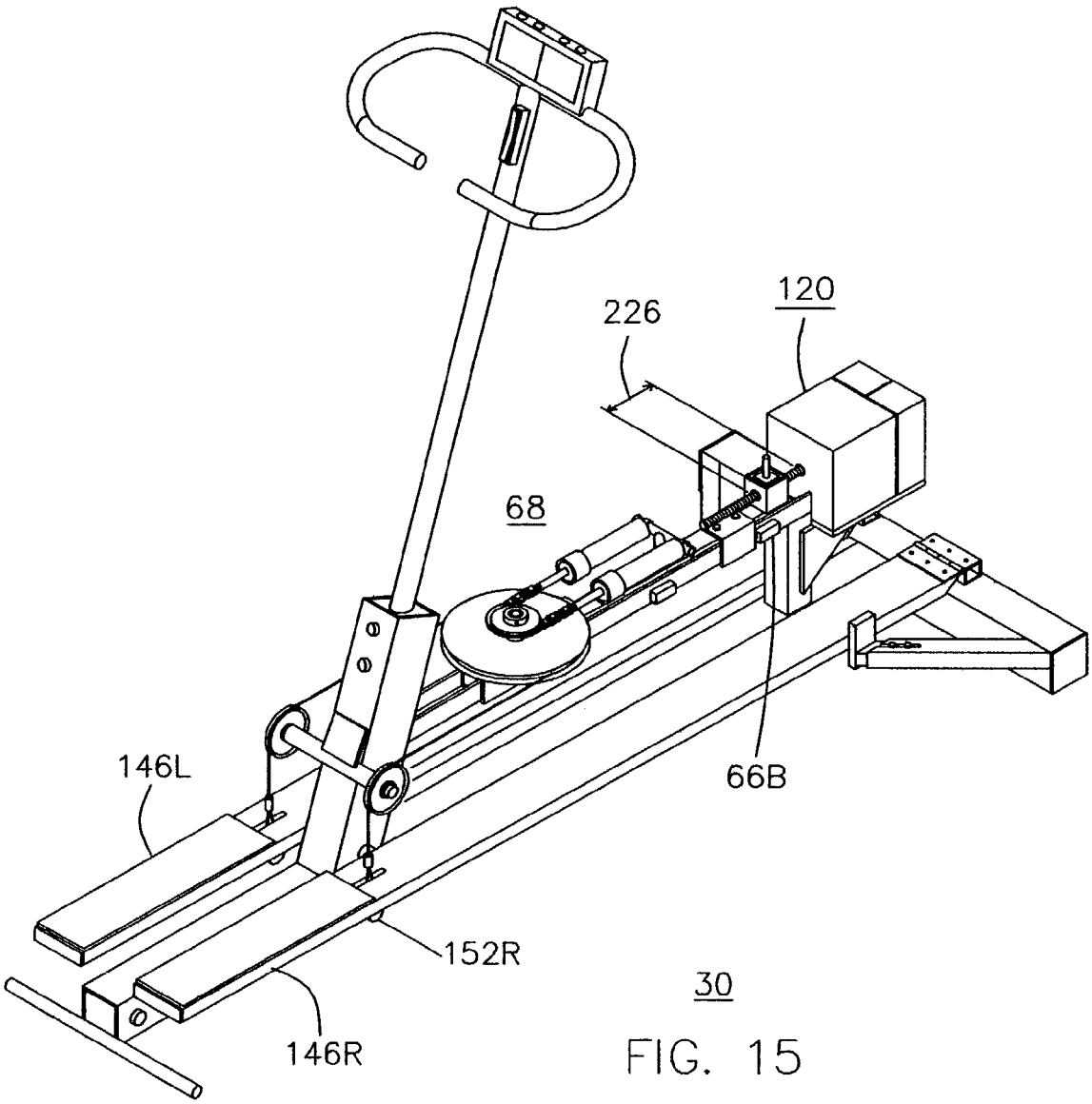
FIG. 15 shows the stepper in pedals-up position.

In FIG. 14 after the user has mounted the lever-arms 146, the top end of the rocker-switch 62 is pushed in. In FIG. 11 the two circuits under switch end "up" are closed. In FIG. 13 the top of the rocker-switch 62 is closed (opposite shown). Contacts 64 allow the current to pass through the normally-closed switch (limit-switch) 66B FIG. 11 and to the motor 140 and back to the power source 58. The screw shaft 136 FIG. 14 turns clockwise pulling the carriage 108 FIG. 11 in the direction of arrow 222A. This action continues until the rocker-switch 62 FIG. 13 is released see FIG. 12 interrupting the current flow. Or the normally-closed switch 66B FIG. 11 is forced open by carriage-keeper 110B. The transmission 68 FIG. 15 moves towards the elevator 120 and the cable crossbars 152, lever-arms 146 and the user move upward until, in this instance, the normally-closed switch 66B is forced open. Now the right lever-arm 146R is moved downward by the action of the user's right foot.

Figure 16:
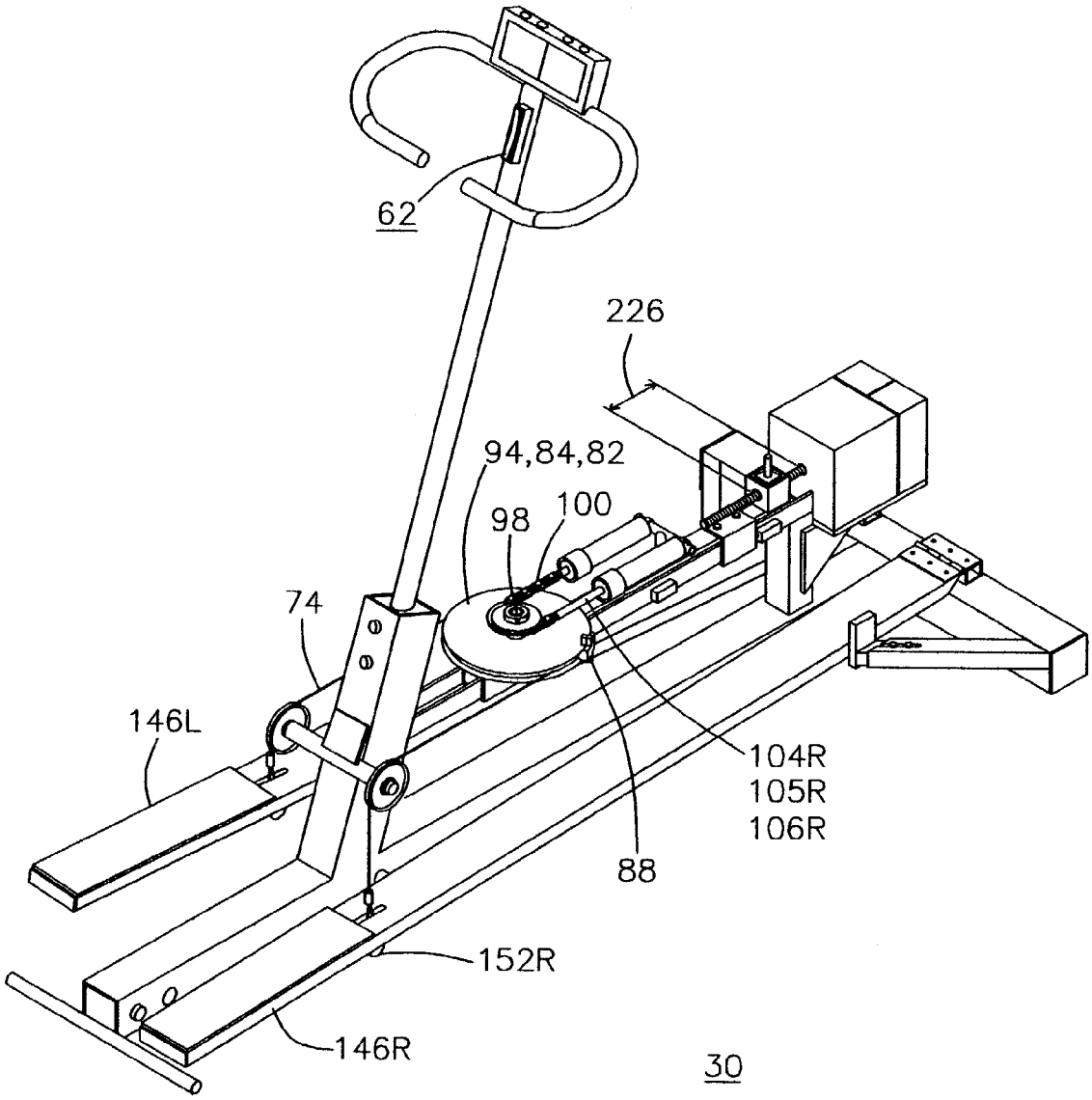
FIG. 16 shows the stepper in full-stroke position.

The cable-crossbar 152R FIG. 16 is moved downward pulling cable 74 that is locked to pulley 94 by cable-clamp 88. The pulley 94, hollow-drive-shaft 84 and sprocket 82 turn clockwise around pinion post 98. Driven-wheel 82 pulls the right end of chain 100 so that shaft 104R is pulled out of damper 106R against a resistance force that is set by the force-setting-ring 105R. The left end of chain 100 is taken up by the internal spring of the left damper 106L. The cable 74 continues around pulley 94 to the lever-arm 146L that is raised by the cable-crossbar 152L to produce, in this instance, a maximum stroke of 8-inches. The user now shifts his or her weight to the left foot and starts a reverse cycle of the above. At any time the user can adjust the stroke height with the rocker-switch 62 to find the most comfortable position. When the user wants to get off of the stepper he simply pushes the bottom end of the rockerswitch 62 and is lowered to the floor for an easy dismount.

The previous section emphasized the following objects and advantages:

(a) the special features of the stepper are easy to use;

(b) the stepper is easily adaptable to electric controls;

(c) besides lowering the pedals for easy mounting, the stepper's rocker-switch is also an infinitely-variable-stroke-adjustment that can be used to adjust the stroke to any size user;

(d) the stepper's dampers have adjusting rings that make it easy to set the resistance force.

The most important objects and advantages of the present invention are that it's a dependent-pedal-type-stepper that is easy to use and mount with pedals that are on the floor, that it has a means to return the pedals to the neutral position, that the stepper needs only one take-off on each lever-arm that connects to both an energy dissipation means and a pedal dependency means and that the stepper can be broken down into a box and shipped by common carrier.

Other advantages to consider are that the present invention provides a fast, easy and convenient aerobic workout. This is important because experts in physical training believe that an easy and convenient method of exercise is the number one factor to determine whether an individual will stick with an exercise program. Sticking to an exercise program is important because many physicians believe that daily moderate exercise is the highest factor for over all good health and longevity. A less expensive version of the stepper can be purchased while the user is middle-aged and later when the user can afford it or needs it the user can purchase the elevator to make the stepper the easiest to use and mount exercise apparatus available. A bolt and nut assembly and a through hole (not shown) to lock the frame-slide-rail and the transmission-carriage together is the only additional hardware needed for the less expensive model.

Although the description above contains many specifics, these should not be construed as limiting the scope of the invention but as merely providing an illustration of the presently preferred embodiment of this invention. For example, in respect to the chain and cable of the previous description, the chain could be a cable with appropriate wheels, and the cable could be a chain with appropriate wheels. There are many devices that could be used for a lever-arm-pivot besides a door hinge.

Although a preferred embodiment has been shown and described, it should be understood that many changes and modifications could be made therein without departing from the scope of the appended claims.

What is claimed is:

1. A transmission for use with an exercise machine, said exercise machine having two foot pedals and a plurality of substantially equally sized linear hydraulic dampers each of said hydraulic dampers having a piston therein and a return-spring and said transmission comprising:

(a) a pinion-post, (b) a drive shaft concentrically mounted on and pivotal around said pinion-post, (c) a drive-wheel fixedly and concentrically located around said drive shaft, (d) a first means for making said dependent on each other and for transmitting mechanical energy from said foot pedals to said drive-wheel, (e) a driven-wheel fixedly and concentrically located around said drive shaft, (f) a second means for transmitting mechanical energy from said driven-wheel to said hydraulic dampers, (g) a structural means for holding said linear hydraulic dampers, said pinion-post, said drive shaft, said drive-wheel, said first means, said driven wheel, and said second means in a working positional relationship to each other whereby said first means in combination with said return-springs maintain each of said foot pedals at its neutral position.

* * * * *

UNITED STATES PATENT AND TRADEMARK OFFICE

CERTIFICATE OF CORRECTION

PATENT NO. : 7,156,776 B2
APPLICATION NO. : 10/425300
DATED : January 2, 2007
INVENTOR(S) : Donald Clifton Maser It is certified that error appears in the above-identified patent and that said Letters Patent is hereby corrected as shown below:

Col. 8, Line 50, after "said" insert --foot pedals--.

Signed and Sealed this

Twenty-sixth Day of June, 2007

JON W. DUDAS
*Director of the United States Patent and Trademark Office*